US006234837B1

(12) United States Patent
Wu

(10) Patent No.: US 6,234,837 B1
(45) Date of Patent: May 22, 2001

(54) SHIELDING DEVICE WITH INCLUDED NUT FOR AN ELECTRICAL CONNECTOR

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/330,222

(22) Filed: Jun. 10, 1999

(30) Foreign Application Priority Data

Dec. 31, 1998 (TW) ..... 87222071

(51) Int. Cl.[7] ..... H01R 13/73
(52) U.S. Cl. ..... 439/564
(58) Field of Search ..... 439/607, 608, 439/564, 573

(56) References Cited

U.S. PATENT DOCUMENTS 4,641,907 * 2/1987 Althouse et al. ..... 439/607
4,993,971 * 2/1991 Matsuzaki et al. ..... 439/607
5,007,862 * 4/1991 Difibaugh et al. ..... 439/607
5,685,738 * 11/1997 Harting et al. ..... 439/573

* cited by examiner

*Primary Examiner*—Neil Abrams
(74) *Attorney, Agent, or Firm*—Wei Te Chung

(57) ABSTRACT

A shielding device for an electrical connector for fastening to a computer panel comprises a metallic front shell, a metallic rear shell engaging with the front shell, and a hexagonal nut irrotatably received between the front and the rear shells. The front shell defines a pair of opposite tabs and the rear shell defines two pairs of adjacent tabs for engaging with the surfaces of the hexagonal nut to prevent the nut from rotating when engaging with a bolt. The front and the rear shells define front and the rear holes, respectively and the nut defines a screw hole, all the holes being substantially aligned for insertion of the bolt.

13 Claims, 4 Drawing Sheets

SHIELDING DEVICE WITH INCLUDED NUT FOR AN ELECTRICAL CONNECTOR

BACKGROUND OF THE INVENTION

1. Field of the Invention

The present invention relates to a shielding device for an electrical connector, and especially to a shielding device having a screw hole for fastening the electrical connector to another component, such as to a computer enclosure, by means of a screw.

2. Description of Prior Art

Some electrical connectors have a screw hole defined in a shielding shell/insulative body assembly thereof whereby the connector can be mounted to an enclosure by a screw extending through the screw hole thereof. However, when the screw hole is disabled, such as when threads of the screw hole is damaged for frequent insertion of a bolt, the shell with the insulative body must be replaced with the new ones. This is wasteful to change a shell with the insulative body just for the threads of the screw hole thereof being damaged.

BRIEF SUMMARY OF THE INVENTION

A main object of the present invention is to provide a shielding device for an electrical connector which has a nut whereby the electrical connector can be mounted to another component by a bolt threadedly extending through the nut.

The shielding device in accordance with a preferred embodiment of the present invention comprises a front shell, a rear shell engaging with the front shell, and a nut irrotatably received between the front and the rear shells. The front shell defines a front hole therethrough. The rear shell defines a rear hole therethrough aligned with the front hole. The nut defines a screw hole therethrough substantially aligned with the front and the rear holes.

Other objects, advantages and novel features of the invention will become more apparent from the following detailed description when taken in conjunction with the accompanying drawings.

DETAILED DESCRIPTION OF THE INVENTION

Figure 1:
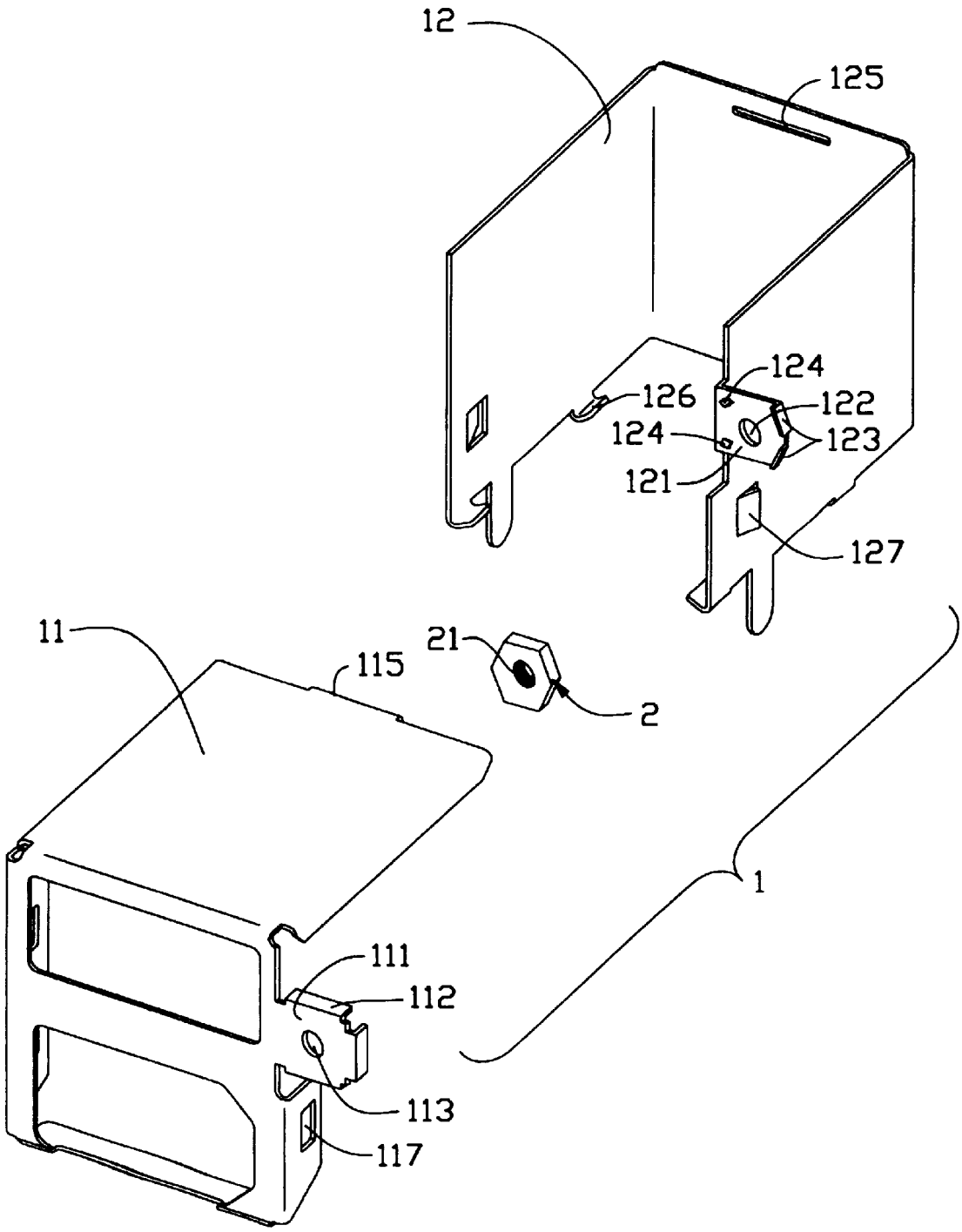
FIG. 1 is an exploded view of a shielding device of the present invention.

Referring to FIG. 1, a shielding device 1 in accordance with the present invention includes a metallic front shell 11, a metallic rear shell 12 engaging with the front shell 11 and a nut 2 received between the front and rear shells 11, 12. The nut 2 is hexagonal and defines a screw hole 21 therein for threadedly engaging with a bolt (not shown). The front shell 11 defines a front mounting portion 111 having a pair of opposite upper and lower tabs 112 extending rearwardly for engaging with a pair of opposite upper and lower outer surfaces of the nut 2. A front hole 113 is defined in the front mounting portion 111 amid the pair of opposite tabs 112. The front shell 11 forms a hook 115 (FIG. 4) on a rear edge thereof and a pair of openings 117 in opposite lateral sides thereof.

The rear shell 12 defines a rear mounting portion 121 corresponding to the front mounting portion 111. The rear mounting portion defines a rear hole 122 therein substantially aligned with the front hole 113. A pair of first adjacent tabs 123 forming an angle of approximately 120 degrees therebetween extend toward the front mounting portion 111 for engaging with a pair of adjacent outer surfaces of the nut 2. A pair of protrusions 124 forming an angle of approximately 120 degrees and opposing the pair of first adjacent tabs 123 engage with another pair of adjacent outer surfaces of the nut 2. The rear shell 12 forms a slot 125 in a rear wall thereof for receiving the hook 115, and a pair of crook pieces 126 on opposite bottom edges thereof. A pair of spring fingers 127 is stamped outwardly from opposite sides of the rear shell 12 for engagement with the pair of openings 117 of the front shell 11.

Figure 2:
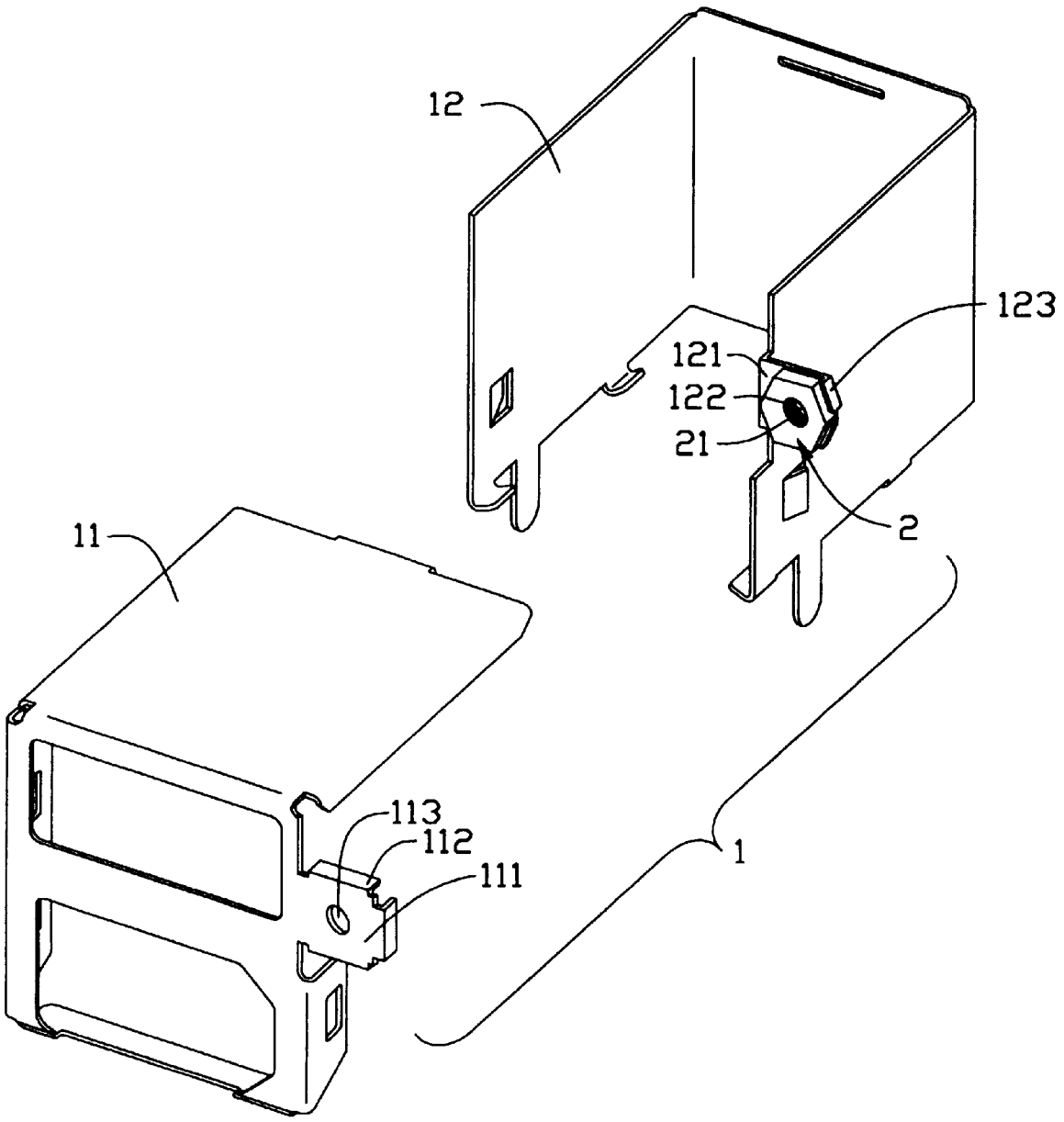
FIG. 2 is a partially assembled view of FIG. 1.
Figure 3:
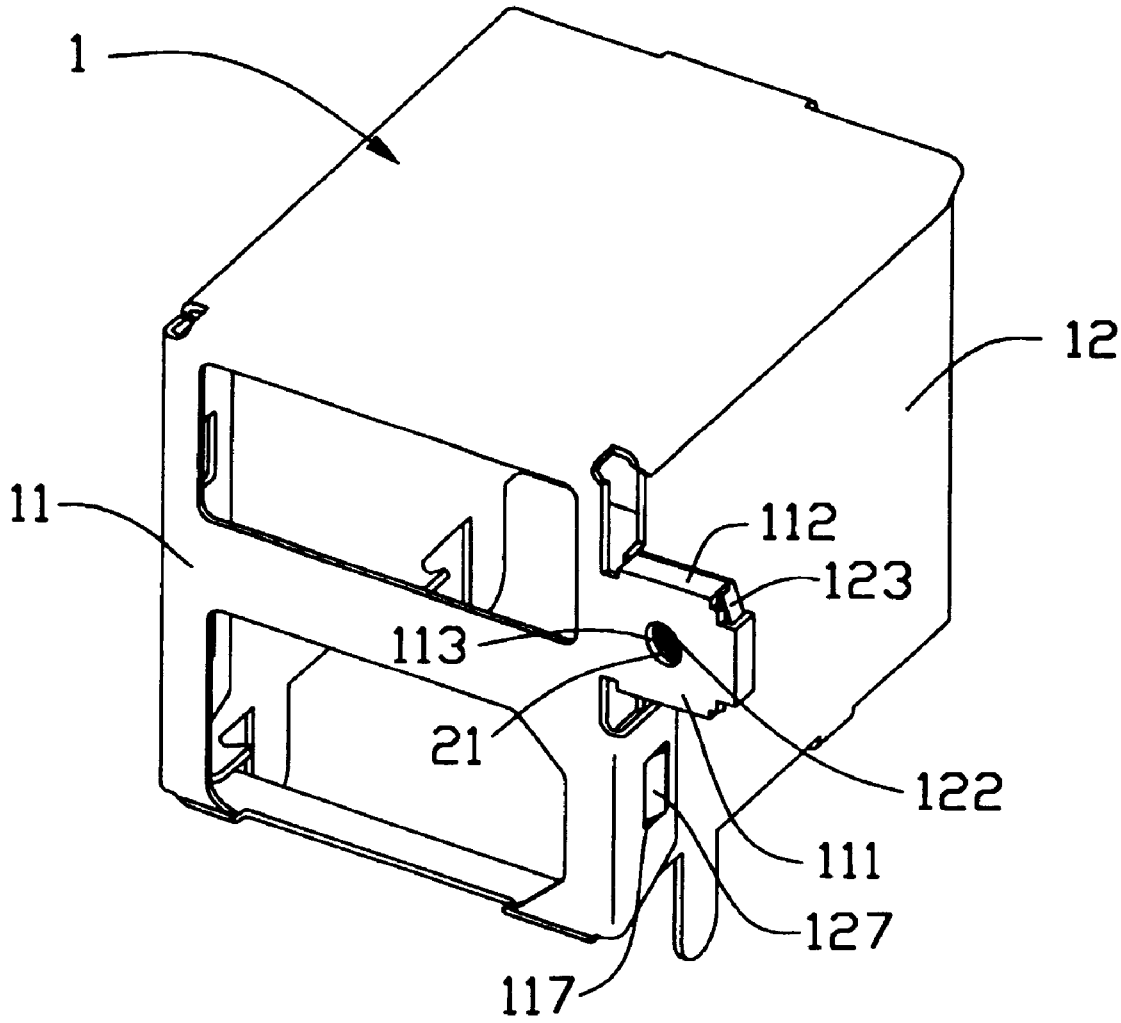
FIG. 3 is an assembled view of FIG. 1.

Referring to FIGS. 2 and 3, in assembly, the front shell 11 engages with the rear shell 12, and the nut 2 is secured between the front and rear mounting portions 111, 121 with the outer surfaces thereof engaging with the corresponding tabs 112, 123, and protrusions 124. Thus, the nut 2 does not rotate when a bolt is threadedly engaged with the screw hole 21 of the nut 2. The screw hole 21 of the nut 2 is substantially aligned with the front and rear holes 113, 122. Thus, the bolt extends through the front hole 113, the screw hole 21 of the nut 2, and the rear hole 122.

Figure 4:
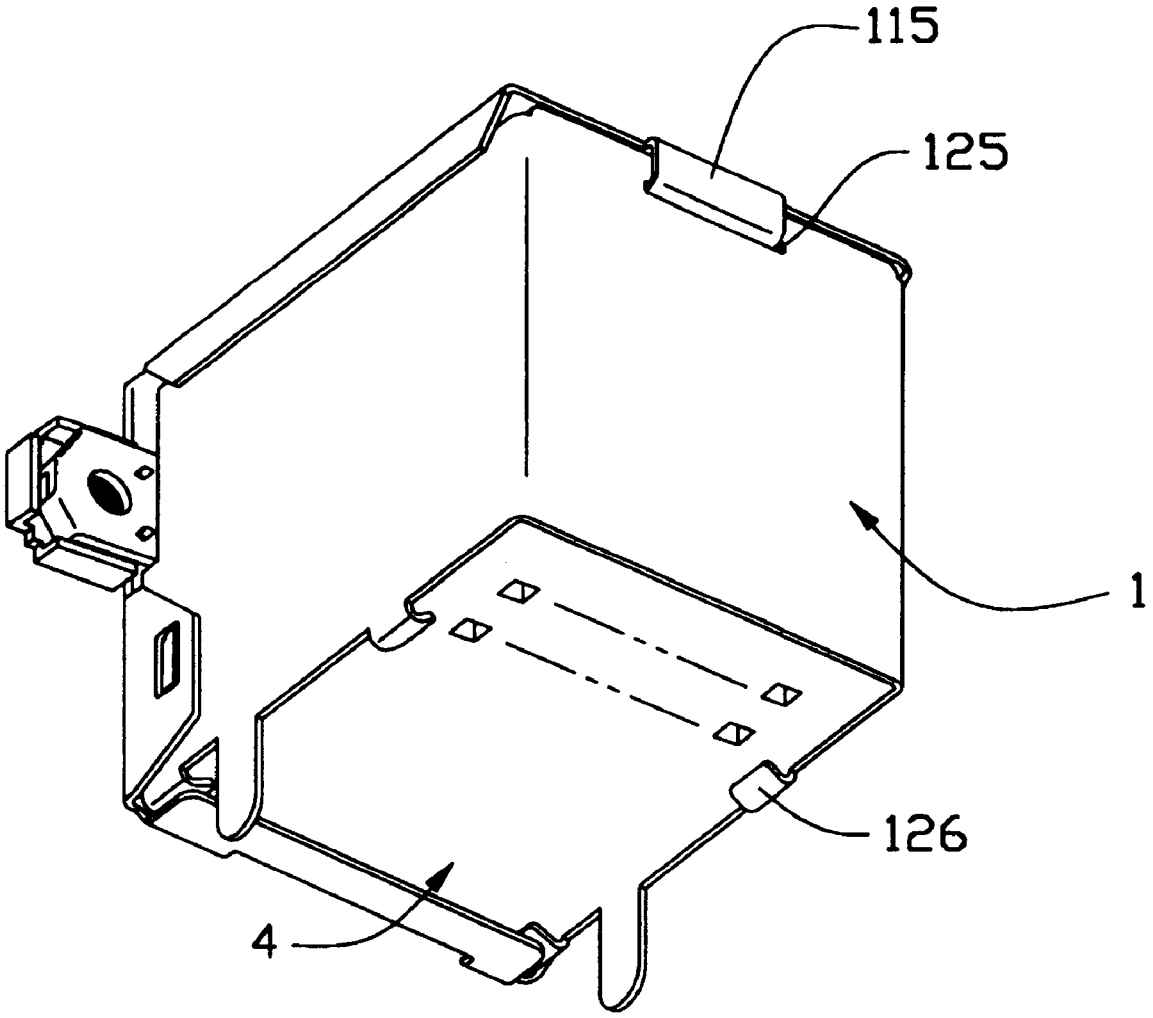
FIG. 4 is an assembled view of an electrical connector embodying the concepts of the present invention.

Referring to FIG. 4, the shielding device 1 receives a body assembly 4 therein. The crook pieces 126 support a bottom surface of the body assembly 4.

It is noted that different from the traditional connector using the internal threaded portion provided within the insulative body of the connector for receipt of a bolt, the invention has the screw hole provided by a nut embedded within a space of the outwardly projecting mounting portion of the shielding device instead without involving the insulative body, thus simplifying fabrication of the insulative body.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shielding device for an electrical connector, comprising:

a metallic front shell defining a front hole therethrough;

a metallic rear shell engaging with the front shell, the rear shell defining a rear hole therethrough aligned with the front hole; and a nut irrotatably received between the front and the rear shells, the nut defining a screw hole therethrough substantially aligned with the front and the rear holes.

2. The shielding device as claimed in claim 1, wherein said nut is hexagonal.

3. The shielding device as claimed in claim 1, wherein said rear shell includes a pair of first adjacent tabs forming an angle of approximately 120 degrees therebetween and extending toward the front shell from adjacent edges thereof to be in flush with a pair of adjacent outer surfaces of the nut.

4. The shielding device as claimed in claim 3, wherein said rear shell includes a pair of protrusions opposing the pair of first adjacent tabs to be in flush with another pair of adjacent outer surfaces of the nut.

5. The shielding device as claimed in claim 4, wherein said front shell defines a pair of opposite tabs extending rearwardly from opposite edges thereof for engaging with a pair of opposite outer surfaces of the nut.

6. An electrical connector comprising:

a metallic front shell having a front mounting portion defining a front hole therethrough;

a metallic rear shell engaging with the front shell, the rear shell having a rear mounting portion corresponding to the front mounting portion and defining a rear hole therethrough aligned with the front hole;

a nut irrotatably received between the front and the rear shells, the nut defining a screw hole therethrough substantially aligned with the front and the rear holes; and a body assembly received between the front and the rear shells.

7. The electrical connector as claimed in claim 6, wherein said nut is hexagonal.

8. The electrical connector as claimed in claim 6, wherein said rear mounting portion includes a pair of first adjacent tabs forming an angle of approximately 120 degrees therebetween and extending toward the front mounting portion from adjacent edges thereof for engaging with a pair of adjacent outer surfaces of the nut.

9. The electrical connector as claimed in claim 8, wherein said rear mounting portion includes a pair of protrusions opposing the pair of first adjacent tabs for engaging with another pair of adjacent outer surfaces of the nut.

10. The electrical connector as claimed in claim 9, wherein said front mounting portion defines a pair of opposite tabs extending rearwardly from opposite edges thereof for engaging with a pair of opposite outer surfaces of the nut.

11. The electrical connector as claimed in claim 6, wherein said front shell forms a hook on a rear edge thereof, and wherein said rear shell defines a slot in a rear wall thereof for receiving the hook.

12. The electrical connector as claimed in claim 6, wherein said rear shell forms a pair of crook pieces on opposite bottom edges thereof for supporting a bottom surface of the body assembly.

13. An electrical connector comprising:

a metallic shielding device defining a space therein;

an insulative body enclosed within the space of said shielding device;

a mounting portion provided on the shielding device and extending outwardly and laterally opposite to said insulative body; and an internally threaded portion disposed on the mounting portion for threaded engagement with an externally threaded bolt without getting the insulative body involved therein; wherein said mounting portion is provided by a nut irrotatably embedded within a cavity formed in said shielding device.

* * * * *